United States Patent [19]

Dragone

[11] Patent Number: 4,491,848

[45] Date of Patent: Jan. 1, 1985

[54] SUBSTANTIALLY FREQUENCY-INDEPENDENT ABERRATION CORRECTING ANTENNA ARRANGEMENT

[75] Inventor: Corrado Dragone, Little Silver, N.J.

[73] Assignee: AT&T Bell Laboratories, Murray Hill, N.J.

[21] Appl. No.: 412,792

[22] Filed: Aug. 30, 1982

[51] Int. Cl.[3] ..... H01Q 19/19

[52] U.S. Cl. ..... 343/781 P; 343/914

[58] Field of Search ..... 343/781 R, 781 P, 781 CH, 343/840, 909, 912, 914

[56] References Cited

U.S. PATENT DOCUMENTS

| | | | |
|---|---|---|---|
| 3,146,451 | 8/1964 | Sternberg | 343/753 |
| 3,688,311 | 8/1972 | Salmon | 343/755 |
| 3,737,909 | 6/1973 | Bartlett et al. | 343/755 |
| 3,792,480 | 2/1974 | Graham | 343/781 |
| 3,821,746 | 6/1974 | Mizusawa et al. | 343/781 |
| 3,828,352 | 8/1974 | Drabowitch et al. | 343/837 |
| 3,845,483 | 10/1974 | Soma et al. | 343/761 |
| 3,922,682 | 11/1975 | Hyde | 343/761 |
| 3,995,275 | 11/1976 | Betsudan et al. | 343/781 |
| 4,145,695 | 3/1979 | Gans | 343/779 |
| 4,166,276 | 8/1979 | Dragone | 343/781 |
| 4,203,105 | 5/1980 | Dragone et al. | 343/781 |
| 4,224,626 | 9/1980 | Sternberg | 343/911 |
| 4,339,757 | 7/1982 | Chu | 343/779 |
| 4,343,004 | 8/1982 | Ohm | 343/781 P |

OTHER PUBLICATIONS

Panicali et al., A Reflector Antenna Corrected for Spherical, Coma and Chromatic Aberrations; Proc of IEEE, vol. 59, No. 2; Feb. 1971, pp. 311, 312.

Ohm et al., Numerical Analysis . . . Offset Cass. Antennas; A1AA/CAS1, 6th Comm. Sat. Conf., Montreal, Can., Paper 76-301, Apr. 5-8, 1976.

Wong et al., Astigmatic Correction by a Deformable Subreflector, AP-S, Int. Symp., vol. II, Seattle, Wash., 1979, pp. 706-709.

*Primary Examiner*—Eli Lieberman

*Attorney, Agent, or Firm*—Erwin W. Pfeifle

[57] ABSTRACT

The present invention relates to an antenna arrangement which uses a large offset spherical main reflector to communicate with several, spaced-apart, remote locations. Large aberrations caused by the main reflector are corrected by a first subreflector forming a small image of the main reflector at a conjugate image surface and a second subreflector which is disposed at the image location and is shaped to correct for the aberrations caused by the main reflector. Such correction is, to a good approximation, frequency independent and provides aberration free operation at feeds adjacent each other and associated with remote locations having small differential angles of incidence on the center of the main reflector.

2 Claims, 5 Drawing Figures

SUBSTANTIALLY FREQUENCY-INDEPENDENT ABERRATION CORRECTING ANTENNA ARRANGEMENT

BACKGROUND OF THE INVENTION

1. Field of the Invention

The present invention relates to a substantially frequency-independent aberration correcting antenna arrangement and, more particularly, to an antenna arrangement which comprises, in sequence along a feed axis thereof, a large offset main reflector, a pair of subreflectors and feeds for communicating with several, spaced-apart remote locations. Large aberrations caused by the main reflector are corrected by disposing one subreflector to form a small image of the main reflector and disposing the second subreflector at the image location and shaped to correct for the aberrations caused by the main reflector.

2. Description of the Prior Art

Except for possibly the axial beam of an antenna, reflectors generally will introduce some sort of aberration if the feedhorn is located away from the geometrical focus. consequently, the wavefront of an off-axis beam is not planar. This is especially true in a multibeam reflector antenna system. Antenna systems, however, have been previously devised to correct for certain aberrations which have been found to exist.

U.S. Pat. No. 3,146,451 issued to R. L. Sternberg on Aug. 25, 1964 relates to a microwave dielectric lens for focusing microwave energy emanating from a plurality of off-axis focal points into respective collimated beams angularly oriented relative to the lens axis. In this regard also see U.S. Pat. No. 3,737,909 issued to H. E. Bartlett et al on June 5, 1973.

Other antenna system arrangements are known which use subreflectors and the positioning of feedhorns to compensate for aberrations normally produced by such antenna systems. In this regard see, for instance U.S. Pat. Nos. 3,688,311 issued to J. Salmon on Aug. 29, 1972; 3,792,480 issued to R. Graham on Feb. 12, 1974; and 3,821,746 issued to M. Mizusawa et al on June 28, 1974.

U.S. Pat. No. 3,828,352 issued to S. Drabowitch et al on Aug. 6, 1974 relates to microwave antennas including a toroidal reflector designed to reduce spherical aberrations. The patented antenna structure comprises a first and a second toroidal reflector centered on a common axis of rotation, each reflector having a surface which is concave toward that common axis and has a vertex located in a common equatorial plane perpendicular thereto.

U.S. Pat. No. 3,922,682 issued to G. Hyde on Nov. 25, 1975 relates to an aberration correcting subreflector for a toroidal reflector antenna. More particularly, an aberration correcting subreflector has a specific shape which depends on the specific geometry of the main toroidal reflector. The actual design is achieved by computing points for the surface of the subreflector such that all rays focus at a single point and that all pathlengths from a reference plane to the point of focus are constant and equal to a desired reference pathlength.

An arrangement was disclosed in the article "A Reflector Antenna Corrected for Spherical, Coma and Chromatic Aberrations" by A. R. Panicali et al in *Proceedings of the IEEE,* Vol. 59, No. 1, February, 1971, at pp. 311–312 where a corrugated reflector with varying depths of corrugations was suggested.

In the article "Astigmatic Correction by a Deformable Subreflector" by W-Y Wong et al in *AP-S International Symposium,* Vol. II, Seattle, Wash. 1979, at pp. 706–709, a mechanically deformable subreflector is suggested for providing a first order astigmatic correction. Other astigmatic correction arrangements have been disclosed in, for example, U.S. Pat. Nos. 4,145,695 issued to M. J. Gans on Mar. 20, 1979 and 4,224,626 issued to R. L. Sternberg on Sept. 26, 1980. The Gans patent provides an astigmatic launcher reflector for each off-axis feedhorn which has a reflector having a curvature and orientation of its two orthogonal principal planes of curvature which are chosen in accordance with specific relationships. The Sternberg patent uses a lens having an elliptical periphery and surfaces defined by a system of nonlinear partial differential equations.

U.S. Pat. No. 4,166,276 issued to C. Dragone on Aug. 28, 1979 relates to an offset antenna having improved symmetry in the radiation pattern and comprising a curved focusing main reflector, at least one conic subreflector and a feedhorn; the combination of these elements being oriented such that the feedhorn is disposed at the focal point of the combined confocal reflectors and in a manner to coincide with the equivalent axis of the antenna system. Such arrangement allegedly eliminates astigmatism to a first order approximation.

More recently, U.S. Pat. No. 4,339,757 issued to T. Chu on July 13, 1982 and allowed U.S. patent application Ser. No. 209,944 filed on Nov. 24, 1980 for E. A. Ohm, now U.S. Pat. No. 4,343,004, each disclose different astigmatic correction means comprising a first and a second doubly curved subreflector which are curved in orthogonal planes to permit the launching of an astigmatic beam of constant size and shape over a broadband range.

The foregoing aberration correction arrangements, however, are primarily designed to provide such correction generally for certain particular feed locations. The problem remaining in the prior art is to provide an antenna arrangement for multibeam transmission which will correct for aberrations at multiple feeds near each other.

SUMMARY OF THE INVENTION

The foregoing problem has been solved in accordance with the present invention which relates to a substantially frequency-independent aberration correcting antenna arrangement and, more particularly, to an antenna arrangement which comprises, in sequence along a feed axis thereof, a large offset main reflector, a pair of subreflectors and feeds for communicating with several, spaced-apart remote locations. Large aberrations caused by the main reflector are corrected by disposing one subreflector to form a small image of the main reflector and disposing the second subreflector at the image location and shaped to correct for the aberrations caused by the main reflector.

Other and further aspects of the present invention will become apparent during the course of the following description and by reference to the accompanying drawings.

BRIEF DESCRIPTION OF THE DRAWINGS

Referring now to the drawings, in which like numerals represent like parts in the several views.

DETAILED DESCRIPTION

Figure 1:
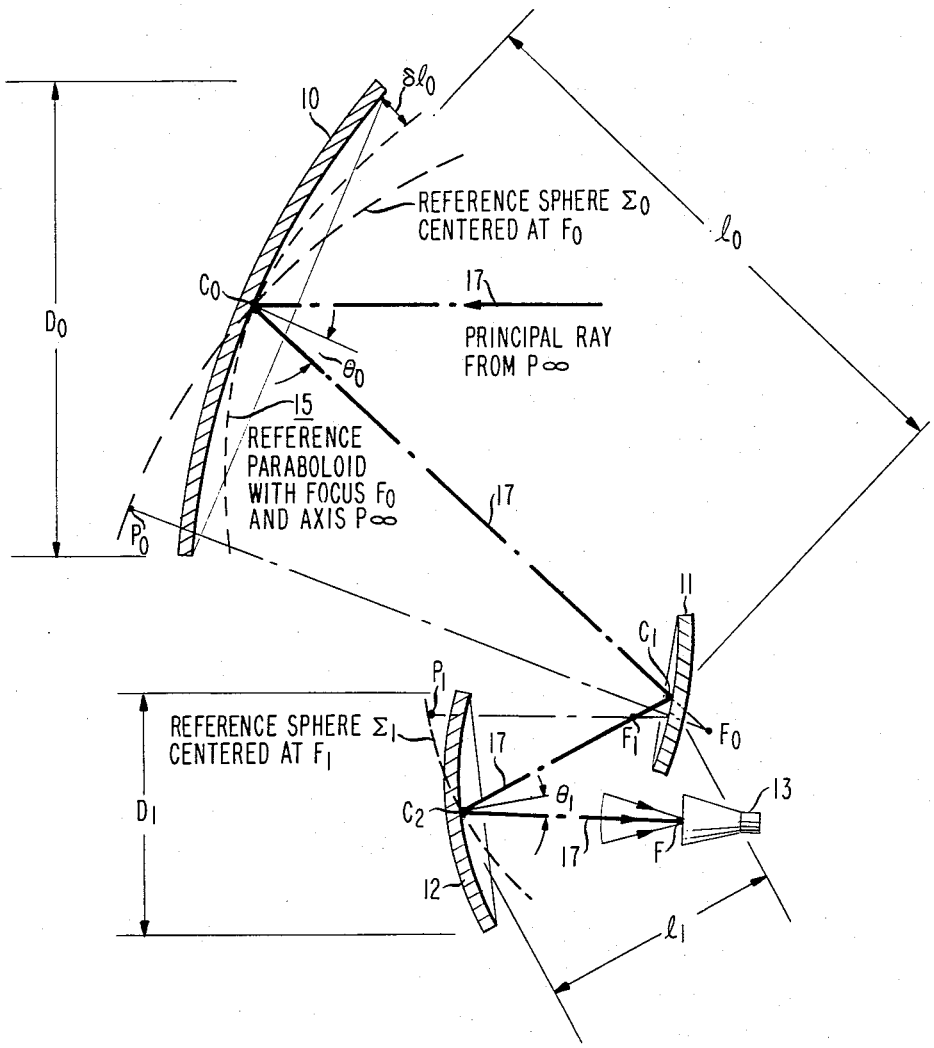
FIG. 1 is a side view in cross-section of an antenna arrangement in accordance with the present invention for correcting for aberrations caused by a main reflector.

FIG. 1 illustrates an antenna arrangement according to the present invention comprising an offset main spherical reflector 10 with a diameter $D_0$, a first and a second subreflector 11 and 12 that correct for aberrations caused by the main reflector 10, and a feed 13 disposed at a focal point F. Main reflector 10 and first and second subreflectors 11 and 12 are centered at points $C_0$, $C_1$ and $C_2$, respectively. First subreflector 11 comprises an ellipsoidal reflecting surface with the foci thereof located at points $C_0$ and $C_2$ for providing a small image of the aperture of main reflector 10 in the area around point $C_2$. The aberrations of this image in the area of $C_2$ are corrected by second subreflector 12 whose diameter $D_1$ is determined by the image magnification M, where $M=D_0/D_1=l_0/l_1$, $l_0$ and $l_1$ being the distances of points $C_0$ and $C_2$ from point $C_1$, respectively.

Because of aberrations, the wavefronts reflected by main reflector 10 have different focal lines in the two principal planes of curvature. In order to minimize the diameter of first subreflector 11, it is convenient to choose the location of subreflector 11 in the vicinity of these focal lines. Concerning the magnification M, which determines the size of subreflector 12 and the distance $l_1$, it can be shown that aberrations caused by a small displacement of the feed 13 from point F increase with M, and the aberrations become large if M is large, i.e., $M>10$. For this reason the value of M should be chosen preferably equal to around 5 where aberrations do not depend critically on M.

For a clear understanding of the present invention, it should be noted that the aberrations of the wave reflected by main reflector 10 can be eliminated by replacing main reflector 10 with a suitable paraboloid so as to produce a spherical wave converging to point $C_1$. Then, using an ellipsoid subreflector 12 at point $C_2$ with foci at points $C_1$ and F, an arrangement free of aberrations is obtained. However, here it is assured that main reflector 10 differs from the above-mentioned paraboloid and this difference causes a corresponding aberration at the image point $C_2$ on second reflector 12. This aberration is corrected by applying to second subreflector 12 a small deformation $\delta l_1$. Then, after reflection by second subreflector 12, a spherical wave converging to focal point F is obtained and signals can be received efficiently by a conventional feed 13 disposed at focal point F.

Figure 5:
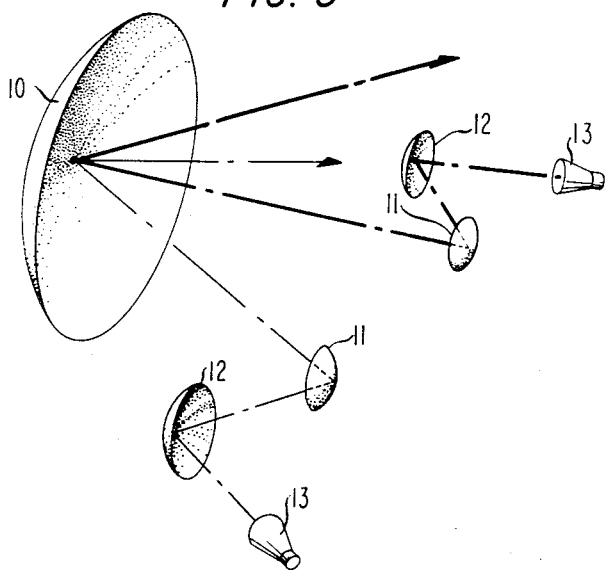
FIG. 5 illustrates the use of two conjugate reflectors to permit communication with two, widely spaced transmitters or receivers without aberrations at the feeds.

This technique allows aberrations to be corrected entirely only for a particular remote receiver or transmitter location such as, for example, a satellite corresponding to the focal point F. Thus, in the vicinity of point F there will be some aberrations which will increase linearly with distance from F. These aberrations can be minimized, to a first order approximation, by properly choosing the angle of incidence $\theta_1$ on second subreflector 12. This choice will allow several feeds in the vicinity of point F to communicate simultaneously with several remote receivers or transmitters. Furthermore, by combining the spherical main reflector 10 with several conjugate subreflectors 12 as shown in FIG. 5, it will be possible to communicate efficiently with several widely spaced transmitters or receivers covering the field of view of 40 degrees or more.

Turning now to the more detailed description, main reflector 10 may not necessarily be a paraboloid and, even if it is a paraboloid, it will not in general be oriented with its axis in the direction of the remote receiver or transmitter which hereinafter will be considered a satellite. To understand the purpose of second subreflector 12, it is convenient to replace temporarily in FIG. 1 main reflector 10 with a reference paraboloid 15 with its axis in the satellite direction, and with the same focal length as the main reflector 10. As a result, signals from the satellite will give rise, after reflection by the paraboloid 15, to a spherical wave converging towards the focus $F_0$ of paraboloid 15.

For purposes of simplification, assume that the main reflector 10 diameter $D_0$ is appreciably smaller than the focal length $f_0$. Now consider through point $C_0$ on main reflector 10 a reference sphere $\Sigma_0$ centered at $F_0$ of FIG. 1. Then after reflection by reference paraboloid 15, the wave will illuminate on $\Sigma_0$ approximately a region of diameter $D_0$ and, in this region, the illumination will have uniform phase distribution to a good approximation. After reflection by first subreflector 11, the field produced in the vicinity of point $C_2$ can be determined in the following manner.

Through point $C_2$ on second subreflector 12 there is drawn a sphere $\Sigma_1$ centered at point $F_1$ and satisfying the lens equation $$\frac{1}{C_1F_1}+\frac{1}{C_1F_0}=\frac{1}{f} \tag{1}$$

where the focal length f is given by $$\frac{1}{l_0}+\frac{1}{l_1}=\frac{1}{f}. \tag{2}$$

Since points $C_0$ and $C_2$ are conjugate points, the field distribution over the sphere $\Sigma_1$ is approximately the image of the distribution of sphere $\Sigma_0$ and is uniform thereover. By placing at point $C_2$ a reference ellipsoid with foci at points $F_1$ and F, the spherical wave from $F_1$ will be transformed into a spherical wave converging to point F. A conventional feed with a phase center at F can then be used to receive efficiently the satellite signals. It should be noted that all foci $F_1$, $F_0$ and F in FIG. 1 are located on the particular ray 17 corresponding to the center point $C_0$ of main reflector 10. The path of ray 17 will be called the principal ray for the satellite at remote point $P_\infty$.

Figure 2:
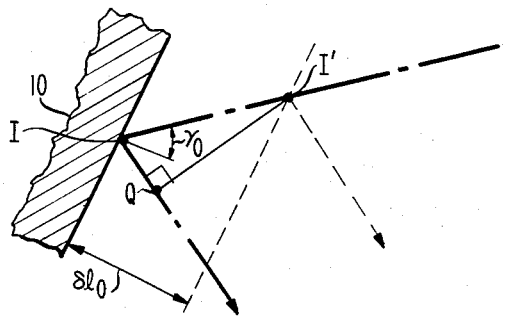
FIG. 2 is an illustration of a variation in path length caused by a small deformation of a reflecting surface.

If the main reflector 10 is a sphere and not a paraboloid, then the wave reflected from main reflector 10 will no longer have a uniform phase over reference sphere $\Sigma_0$, but rather will have a phase error $\Phi_0$ due primarily to coma and astigmatism. This phase error $\Phi_0$ can be derived as follows. The sphere 10 is only slightly different from the reference paraboloid 15 since both reflectors have approximately the same focal length. Thus, by slightly deforming the paraboloid one can make a sphere. If $\delta l_0$ denotes the required deformation as shown in FIG. 2, a simple relationship exists between $\Phi_0$ and $\delta l_0$ which is $$\Phi_0 \simeq 2k\delta l_0 \cos \gamma_0, \tag{3}$$

where $k=2\pi/\lambda$ and $\gamma_0$ is the angle of incidence.

Because of the phase error $\Phi_0$, there will be over the conjugate sphere $\Sigma_1$ a corresponding phase error $\Phi_1$ given by the image of $\Phi_0$. If $P_0$ and $P_1$ denote two corresponding points of $\Sigma_0$ and $\Sigma_1$, respectively, as in FIG. 1, then $$\Phi_1'(P_1) \simeq \Phi_0(P_0), \tag{4}$$

neglecting aberrations due to the imaging first subreflector 11. The phase error $\Phi_1'$ can now be corrected by slightly deforming the reference ellipsoid to obtain the shape of the final conjugate second subreflector 12. The required deformation $\delta l_1$ is obtained by requiring $\Phi_1+\Phi_1'=0$, where $\Phi_1$ is the phase error produced by $\delta l_1$, and is given by an expression similar to equation (3) using the subscripts 1 instead of 0. Because of the deformation $\delta l_1$, which can be considered to be the image of $\delta l_0$, a spherical wave will be obtained in FIG. 1 after the final reflector by second subreflector 12, which will be aberration free.

Figure 3:
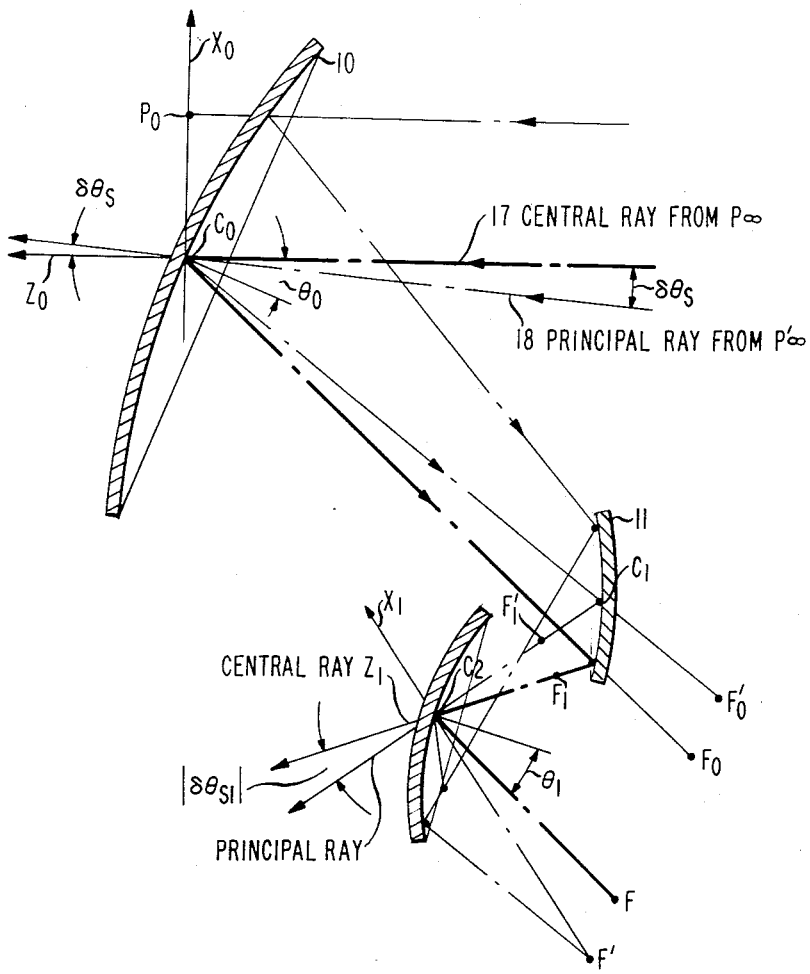
FIG. 3 is a side view in cross-section of the antenna arrangement of FIG. 1 with reference axes used to determine the aberration caused by a small displacement of a remote transmitter or receiver such as a satellite.

Now let the satellite be moved to a slightly different location $P_\infty'$ displaced from $P_\infty$ by the angle $\delta\theta_s$ as shown in FIG. 3. Using the second subreflector 12 designed as mentioned hereinbefore, the signal received from $P_\infty$ will no longer be aberration free. The reference paraboloid 15 of FIG. 1 must be modified, since its foci F' and $F_1'$ must be located on the principal ray 17 for the new satellite position P'. As a consequence, new deformations $\delta l_0$ and $\delta l_1$ corresponding to $P_\infty'$ must be calculated and, in general, the resulting aberrations $\Phi_0$ and $\Phi_1$ will not exactly cancel each other, i.e., $\Phi_1+\Phi_1' \neq 0$ for $\delta\theta_s \neq 0$.

To understand the conditions that must be satisfied in order to minimize the residual aberrations $\Phi_1+\Phi_1'$ for the new satellite location, it will be assumed that for $\delta\theta_s=0$ the deformation $\delta l_0$ is small. Let $\delta d_0$ be its peak value for $\delta\theta_s=0$, and assume that both $k\delta d_0$ and $\delta\theta_s$ are of the same order of magnitude. Then, expanding $\Phi_1+\Phi_1'$ in a power series of $\delta\theta_s$ and $\delta d_0$ and neglecting terms of order higher than one, $$\Phi_1 + \Phi_1' \simeq \left\{ \delta d_0 \frac{\partial}{\partial \delta d_0} + \delta\theta_s \frac{\partial}{\partial \delta\theta_s} \right\}_0 (\Phi_1 + \Phi_1'), \tag{5}$$

where $\{\ \}_0$ indicates that the partial derivatives must be evaluated for $\delta d_0=\delta\theta_s=0$. The first term is zero, since $\Phi+\Phi_1'=0$ for $\delta\theta_s=0$. The second term, calculated for $\delta d_0=0$, represents the phase error arising when the main reflector 10 is a paraboloid. Thus, for the purpose of calculating $\Phi+\Phi_1'$ to a first order approximation, for the following discussion it will be assumed that main reflector 10 is a paraboloid with the axis in the direction of $P_\infty$ for $\delta\theta_s=0$.

Assume, for the three reflectors, a common plane of symmetry, given by the plane of the principal ray for $\delta\theta_s=0$. This particular principal ray 17 will be called the central ray. To determine $\Phi_0$ and $\Phi_1$, it is convenient to introduce coordinate axes $x_0$, $y_0$, $z_0$ and $x_1$, $y_1$, $z_1$ centered at points $C_0$ and $C_2$ with the $z_0$, $z_1$-axes in the directions of the central ray, as shown in FIG. 3.

For $\delta\theta_s \simeq 0$, the principal ray 18 incident on main reflector 10 is rotated by the angle $\delta\theta_s$ with respect to the $z_0$-axis. Let $\delta\theta_s$, $\psi_s$ be its spherical coordinates specifying its direction with respect to the $x_0$, $y_0$, $z_0$-axes. Similarly, at point $C_1$, let $\delta\theta_{s1}$, $\psi_{s1}$ be the spherical coordinates specifying the principal ray 18 incident on second subreflector 12 with respect to the $x_1$, $y_1$, $z_1$-axes. One can show that $$\delta\theta_{s1} \simeq -M\delta\theta_s, \tag{6}$$

$$\psi_{s1} \simeq \psi_s. \tag{7}$$

Consider, on the reference plane $z_0=0$, a point $P_0$ of coordinates $x_0$, $y_0$. Then the ray through $P_0$ determines, after the two reflections by main reflector 10 and first subreflector 11 a point $P_1$ on the plane $z_1=0$ with coordinates $x_1$, $y_1$ given by $$x_0 \simeq -Mx_1 \tag{8}$$

$$y_0 \simeq -My_1. \tag{9}$$

If $\Phi_0$ is expressed in terms of $x_0$, $y_0$ and consideration is restricted to the component due to astigmatism one obtains $$\phi_0 \simeq \partial\theta_s \frac{\pi}{\lambda} \frac{1}{f_0} \tan\theta_0\, p_0^2 \cos(2\psi_0 - \psi_s), \tag{10}$$

where $p_0$, $\psi_0$ are polar coordinates corresponding to $x_0$, $y_0$. Similarly, expressing $\Phi_1$ in terms of $x_1$, $y_1$, $$\Phi_1 \simeq \partial\theta_{s1} \frac{\pi}{\lambda} \frac{1}{f_1} \tan\theta_1\, p_1^2 \cos(2\psi_1 - \psi_{s1}). \tag{11}$$

By requiring $\Phi_0+\Phi_1=0$, taking into account Eqs. (6–9), one obtains $$\frac{M}{f_0} \tan\theta_0 = \frac{1}{f_1} \tan\theta_1. \tag{12}$$

If this condition is satisfied, the arrangement of FIG. 3 is free of astigmatisms for small $\delta\theta_s$ and, therefore, $\Phi_0+\Phi_1$ is of order three in $P_0$.

Figure 4:
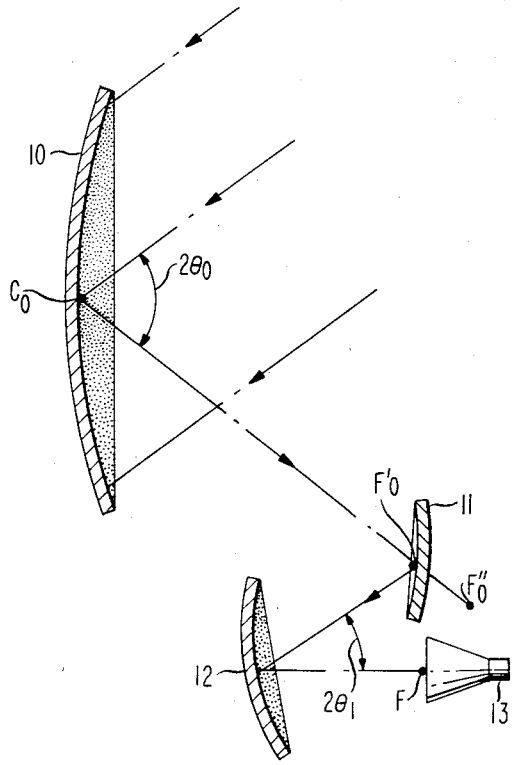
FIG. 4 illustrates that astigmatism caused by a spherical main reflector gives rise to two focal lines with an ellipsoid placed at one of the focal lines and the angle of incidence on the conjugate reflector is chosen to permit aberration correction for feeds placed on an area centered on focal point F.

As an application, FIG 4 shows an arrangement including a main reflector 10 combined with an imaging subreflector 11 and a conjugate subreflector 12 with a predetermined magnification M. For $\theta_0=0$, the dominant aberration caused by spherical main reflector 10 is spherical aberration with a predetermined peak phase error which is negligible. For $\theta_0 \neq 0$, the dominant aberration is astigmatism giving rise to two separate focal lines, at $F_0'$ and $F_0''$, as shown in FIG. 4. The corresponding focal lengths $f_0'=F_0'C_0$ and $f_0''=F_0''C_0$ are given exactly by $$f_0' = \frac{r}{2} \frac{1}{\cos\theta_0}, f_0'' = \frac{2}{r} \cos\theta_0. \quad (13)$$

The focal length $f_0$ is given by $$\frac{1}{f_0} = \frac{1}{2}\left(\frac{1}{f_0'} + \frac{1}{f_0''}\right). \quad (14)$$

The angle of incidence $\theta_0$ is determined by the satellite location. If the field of view is large (for instance, 40 degrees) then large values of $\theta_0$ must be considered. In FIG. 4, for instance, if $2\theta_0$ is large, then according to Eq. (13), the peak phase error due to astigmatism is large and, therefore, a large correction is required. Notice in FIG. 4 that the ellipsoid of subreflector 11 is placed at the first focal line $F_0'$. This minimizes the illuminated area, which is then confined to the immediate vicinity of $F_0'$. The focal length and angle of incidence for the conjugate reflector 12 will then satisfy Eq. (12). The angle $2\delta\theta_s$ can be large as 5 degrees before aberrations in the vicinity of focal point F become noticeable. For larger values of $\delta\theta_s$, there will be some residual astigmatism, which can be corrected using, for instance, an astigmatic feed.

In order to communicate simultaneously with widely spaced satellites, several conjugate reflectors 12, each combined with an ellipsoidal imaging reflector 11 must be used, as illustrated in FIG. 5 for N=2.

What is claimed is:

1. An antenna arrangement comprising:

an offset main reflector including a spherical reflecting surface capable of bidirectionally reflecting a beam of electromagnetic energy between a focal point and a far field area of the main reflector along a feed axis of the antenna arrangement;

a first subreflector disposed along the feed axis of the antenna arrangement near the focal point of the main reflector capable of forming an image of the reflecting surface of the main reflector at a conjugate image surface;

at least one feed disposed along the feed axis of the antenna arrangement capable of launching or receiving a beam of electromagnetic energy; and a second subreflector disposed along the feed axis of the antenna arrangement between the at least one feed and the first subreflector and centered on the image of the main reflector at the conjugate image surface formed by the first subreflector, the second subreflector including a reflecting surface shaped to remove aberrations caused by the offset main reflector from reaching the at least one feed.

2. An antenna arrangement according to claim 1 wherein the main reflector and the first and second subreflector are disposed relative to each other to satisfy the equation $$\frac{M}{f_0} \tan\theta_0 = \frac{1}{f_1} \tan\theta_1$$

where $M = l_0/l_1$ and $l_0$ and $l_1$ are the distances between the center point on the reflecting surface of the first subreflector and the center points on the reflecting surfaces of each of the main reflector and second subreflector, respectively, $f_0$ is the focal length of the main reflector, $f_1$ is the focal length of the second subreflector, and $\theta_0$ and $\theta_1$ are the angle of incidence for a ray propagating along the feed axis of the antenna arrangement and impinging the center points of the main reflector and second subreflector, respectively.

* * * * *